US007410408B2

(12) United States Patent
Shibata

(10) Patent No.: US 7,410,408 B2
(45) Date of Patent: Aug. 12, 2008

(54) EYEGLASS LENS PROCESSING APPARATUS

(75) Inventor: Ryoji Shibata, Toyokawa (JP)

(73) Assignee: Nidek Co., Ltd., Tokyo (JP)

( * ) Notice: Subject to any disclaimer, the term of this patent is extended or adjusted under 35 U.S.C. 154(b) by 5 days.

(21) Appl. No.: 11/702,081

(22) Filed: Feb. 5, 2007

(65) Prior Publication Data

US 2007/0218810 A1 Sep. 20, 2007

(30) Foreign Application Priority Data

Feb. 3, 2006 (JP) ..... P.2006-027306

(51) Int. Cl.
*B24B 49/00* (2006.01)
*B24B 9/02* (2006.01)

(52) U.S. Cl. ..... 451/5; 451/43; 451/65

(58) Field of Classification Search ..... 451/5, 451/42, 43, 57, 58, 255, 256, 65
See application file for complete search history.

(56) References Cited

U.S. PATENT DOCUMENTS

| | | | | |
|---|---|---|---|---|
| 6,048,258 | A | 4/2000 | Shibata | |
| 6,220,927 | B1 | 4/2001 | Mizuno et al. | |
| 6,325,700 | B1 | 12/2001 | Mizuno et al. | |
| 6,478,657 | B1 | 11/2002 | Shibata | |
| 6,702,653 | B2 * | 3/2004 | Shibata | 451/42 |
| 6,719,609 | B2 | 4/2004 | Mizuno et al. | |
| 6,887,134 | B2 * | 5/2005 | Jinbo et al. | 451/43 |
| 6,942,542 | B2 | 9/2005 | Shibata | |
| 2001/0053659 | A1 | 12/2001 | Shibata | |
| 2004/0058624 | A1 | 3/2004 | Suzuki et al. | |
| 2007/0202775 | A1 * | 8/2007 | Shibata | 451/5 |
| 2007/0264906 | A1 * | 11/2007 | Yamamoto et al. | 451/5 |

FOREIGN PATENT DOCUMENTS

| | | | |
|---|---|---|---|
| EP | 1293291 | A2 | 3/2003 |
| FR | 2050537 | A | 4/1971 |
| JP | 2005-046938 | A | 3/2005 |

* cited by examiner

*Primary Examiner*—Robert Rose
(74) *Attorney, Agent, or Firm*—Sughrue Mion, PLLC

(57) ABSTRACT

An eyeglass lens processing apparatus for processing an eyeglass lens includes: a lens chuck that holds the lens; a regular-grooving tool; a first moving unit that moves the lens held by the lens chuck; a grooving data input unit that inputs grooving data including a width and depth of the groove to be formed in the lens; a controller that controls the first moving unit to perform regular-grooving on the basis of the grooving data; a fine-grooving tool; a second moving unit that moves the lens held by the lens chuck; and a selector that selects whether fine-grooving is to be performed. When performance of fine-grooving is selected, the controller performs the regular-grooving on the lens so that a bottom and side surfaces of the groove have a fine-grooving margin, and controls the second moving unit to perform the fine-grooving on the basis of the grooving data.

7 Claims, 9 Drawing Sheets

EYEGLASS LENS PROCESSING APPARATUS

BACKGROUND OF THE INVENTION

The present invention relates to an eyeglass lens processing apparatus for processing an eyeglass lens.

When an eyeglass lens is fixed to an eyeglass frame by wires made of nylon or the like, grooving is performed to form a groove, into which the wire is fitted, on a peripheral surface (an edge surface) of the lens on which roughing and flat-finishing are performed. For this purpose, an eyeglass lens processing apparatus including a grooving unit has been proposed in recent years.

However, according to the grooving in the related art, processing speed has been prior to other conditions and the appearance (quality in shape) of the groove to be formed has not been regarded as an important factor. Accordingly, a grooving grindstone having a granularity of about #400 has been used as a grooving tool. However, in this case, even though polishing (mirror-finishing) is performed on the peripheral surface of the lens, the groove to be formed becomes whitish, so that the appearance is poor. Further, variation in use of grooves, that is, the use not for the purpose of fitting of the wires but decoration of the eyeglass has been regarded.

SUMMARY OF THE INVENTION

It is an object of the invention to provide an eyeglass lens processing apparatus that can form a groove having an excellent appearance on a peripheral surface of an eyeglass lens.

In order to achieve the above-mentioned object, the invention provides an eyeglass lens processing apparatus having the following structure.

(1) An eyeglass lens processing apparatus for processing an eyeglass lens, the apparatus comprising;

a lens chuck that holds the lens;

a regular-grooving tool;

a first moving unit that relatively moves the lens-held by the lens chuck with respect to the regular-grooving tool;

a grooving data input unit that inputs grooving data, the grooving data including a width and depth of the groove to be formed in the lens;

a controller that controls the first moving unit to perform regular-grooving on the lens on the basis of the input grooving data;

a fine-grooving tool;

a second moving unit that relatively moves the lens held by the lens chuck with respect to the fine-grooving tool; and a selector that selects whether or not fine-grooving is to be performed, wherein when performance of the fine-grooving is selected, the controller performs the regular-grooving on the lens so that a bottom and side surfaces of the groove have a margin for the fine-grooving, and controls the second moving unit to perform the fine-grooving on the lens on the basis of the input grooving data.

(2) The eyeglass lens processing apparatus according to (1), wherein a processing width of the regular-grooving tool is smaller than a processing width of the fine-grooving tool by the fine-grooving margin on each of the side surfaces of the groove.

(3) The eyeglass lens processing apparatus according to (2), wherein when non-performance of the fine-grooving is selected, a minimum value of the groove width allowed to be input is limited to the processing width of the regular-grooving tool, and when the performance of the fine-grooving is selected, the minimum value of the groove width allowed to be input is limited to the processing width of the fine-grooving tool.

(4) The eyeglass lens processing apparatus according to (1), wherein a granularity of the regular-grooving tool is in a range of #300 to #800, and a granularity of the fine-grooving tool is in a range of #1000 to #3000.

(5) The eyeglass lens processing apparatus according to (1), wherein the regular-grooving tool and the fine-grooving tool have a same outer diameter and are fixed to a same spindle.

(6) The eyeglass lens processing apparatus according to (1), further comprising:

a roughing tool;

a third moving unit that relatively moves the lens held by the lens chuck with respect to the roughing tool;

a flat-finishing tool;

a fourth moving unit that relatively moves the lens held by the lens chucks with respect to the flat-finishing tool; and a target lens shape data input unit that inputs target lens shape data, wherein the control unit controls the third and fourth moving units to perform roughing and flat-finishing on the lens on the basis of the input target lens shape data.

(7) The eyeglass lens processing apparatus according to (6) further comprising an operation unit that obtains the grooving data based on the input target lens shape data, wherein the grooving data input unit inputs the obtained grooving data.

DESCRIPTION OF THE PREFERRED EMBODIMENTS

Figure 1:
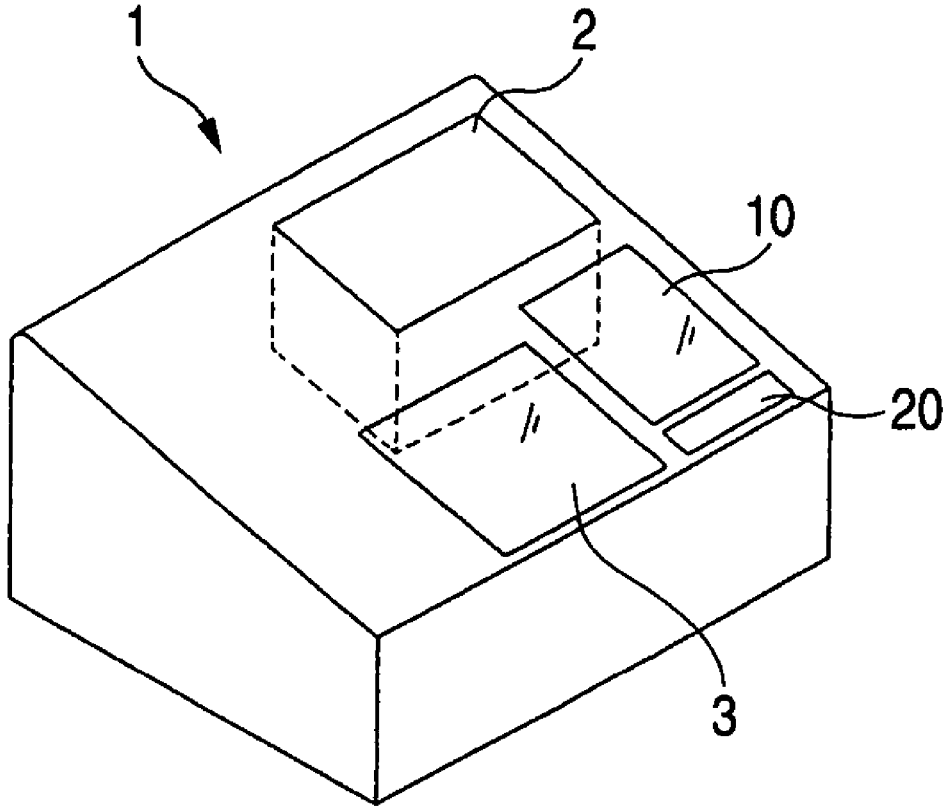
FIG. 1 is a view showing a schematic appearance of an eyeglass lens processing apparatus according to an embodiment of the present invention.

Hereinafter, embodiments according to the invention will be described with reference to accompanying drawings. FIG. 1 is a view showing a schematic appearance of an eyeglass lens processing apparatus according to an embodiment of the invention. An eyeglass lens processing apparatus 1 includes an eyeglass frame measuring device 2. A measuring device disclosed in U.S. Pat. No. 6,325,700B1 (JP-A-2000-314617), etc. can be used as eh measuring device 2) A touch screen display (A display unit) 10, and a switch panel (an operation unit) 20 including a processing start switch and the like are provided on the upper surface of the processing apparatus 1. Reference numeral 3 indicates a cover for opening and closing a processing chamber. Further, the measuring device 2, display 10, switch panel 20, and the like may be separately formed from the processing apparatus 1.

Figure 2:
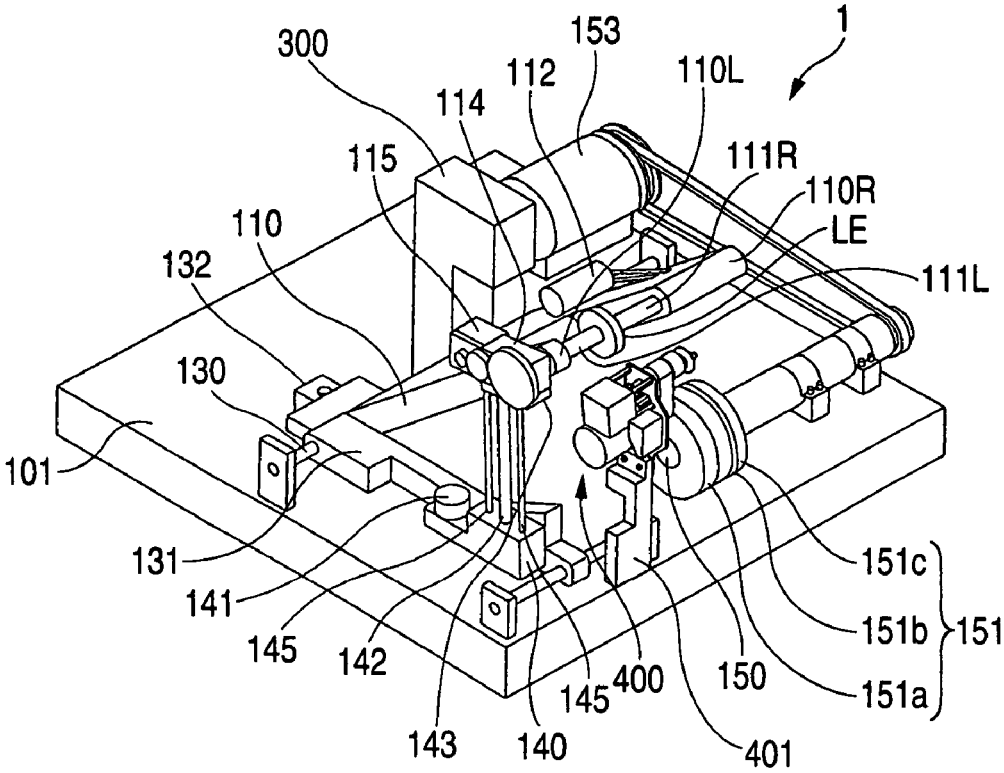
FIG. 2 is a view showing a schematic structure of a lens processing unit.

FIG. 2 is a view showing a schematic structure of a lens processing unit provided in the processing apparatus 1. A lens LE to be processed is rotated while being held (chucked) by lens chucks 111L and 111R included in a carriage 110, and is ground (processed, edged) by a grindstone 151 used as a processing (grinding, edging) tool that is attached to a grindstone spindle 150 and rotated. The grindstone 151 according to the present embodiment includes three grindstones of a roughing grindstone 151*a* for plastic, a regular-finishing grindstone 151*b*, and a polishing grindstone 151*c*. Each of the grindstones 151*b* and 151*c* has a V-shaped-groove for beveling and a plane-processing surface. The grindstone spindle 150 is rotated by a grindstone rotating motor 153 via torque transmission members such as a belt.

A block 114 capable of rotating about a rotation axis of the lens chuck 111L is attached to a left arm 110L of the carriage 110. A lens rotating motor 115 is fixed to the block 114, and the torque of the motor 115 is transmitted to the lens chuck 111L provided to the left arm 110L via torque transmission members such as a gear, so that the lens chuck 111L is rotated. Further, the torque of the lens chuck 111L is transmitted to the lens chuck 111R provided to a right arm 110R of the carriage 110 via torque transmission members such as a belt disposed in the carriage 110, so that the lens chuck 111R is rotated in synchronization with the lens chuck 111L.

When the processing is performed, a cup used as a fixing jig is attached to the front surface (front refracting surface) of the lens LE by an adhesive tape, so that a base of the cup is mounted on a lens receiver provided at the end of the lens chuck 111L. A lens holding (chucking) motor 112 for moving the lens chuck 111R in an axial direction of the lens chuck 111R is fixed to the right arm 110R, and the torque of the motor 112 is transmitted to the lens chuck 111R via torque transmission members such as a belt and axial movement members disposed in the carriage 110, so that the lens chuck 111R is moved in a direction in which it approaches the lens chuck 111L. A lens retainer is fixed to the end of the lens chuck 111R and the lens retainer comes in contact with the rear surface (rear refracting surface) of the lens LE, so that the lens LE is held (chucked) by the lens chucks 111L and 111R.

The carriage 110 is rotatably and slidably mounted on a carriage shaft 130 parallel to the lens chucks 111L and 111R, and is moved together with a moving arm 131 toward the left or right side (hereinafter, referred to as an "X-direction") that is an axial direction of the carriage shaft 130 by a motor 132 for moving the carriage toward the left or right side. Further, a block 140 capable of being rotated about a rotation axis of the grindstone spindle 150 is attached to the moving arm 131. A motor 141 for moving the carriage vertically and two guide shafts 145 are fixed to the block 140, and a lead screw 142 is rotatably attached to the block 140. The torque of the motor 141 is transmitted to the lead screw 142 via torque transmission members such as a belt, so that the lead screw 142 is rotated. A guide block 143 coming in contact with the lower surface of the block 114 is fixed to the upper end of the lead screw 142. The guide block 143 is moved along the guide shafts 145. The carriage 110 is rotated about the carriage shaft 130 in the vertical direction (in a direction in which a distance between the rotating axis of the lens chucks 111L and 111R and the rotation axis of the grindstone spindle 150 is changed. Hereinafter, referred to as a "Y-direction") due to the movement of the guide block 143. Further, a spring is elastically provided between the carriage 110 and the moving arm 131, and the carriage 110 is always pushed downward, so that the lens LE is pressed against the grindstone 151. A known structure of a carriage may be used as the above-mentioned structure of the carriage, which is disclosed in U.S. Pat. No. 6,478,657B (JP-A-2001-18155) which is hereby incorporated by reference.

Figure 3:
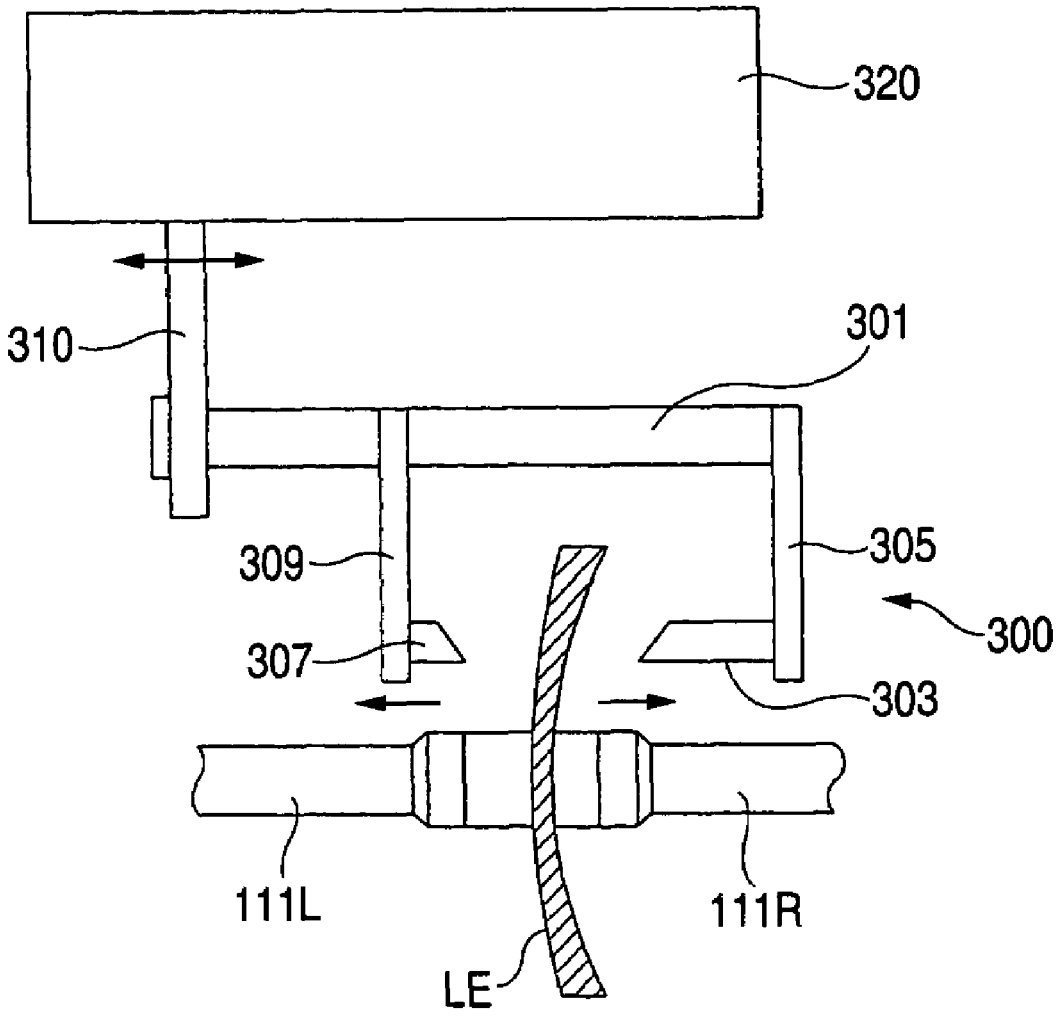
FIG. 3 is a view showing a schematic structure of a lens measuring unit.

A lens measuring unit 300 is disposed on the rear side of the carriage 110. FIG. 3 is a view showing a schematic structure of the lens measuring unit 300 (a unit for measuring the position of the edge of the lens LE). An arm 305 provided with a measuring element 303 for measuring the rear surface of the lens LE is fixed to the right end of a shaft 301. Further, an arm 309 provided with a measuring element 307 for measuring the front surface of the lens LE is fixed to the middle of the shaft 301. A line extending between a contact point of the measuring element 303 and a contact point of the measuring element 307 is parallel to the rotation axis of the lens chucks 111L and 111R. The shaft 301 and a slide base 310 can be moved in the axial direction of the lens chucks 111L and 111R. The movement of the shaft 301 (the slide base 310) in the lateral direction (in the X-direction) is detected by a detecting unit 320 that includes a spring pushing the slide 310 base to a starting point, an encoder, and the like.

When the front shape of the lens LE (the position of the front edge of the lens LE) is measured, the lens LE is moved toward the left side in FIG. 3, so that the measuring element 307 comes in contact with the front surface of the lens LE. The measuring element 307 always comes in contact with the front surface of the lens LE due to the spring of the detecting unit 320. In this state, while the lens LE is rotated, the carriage 110 is moved in the Y-direction on the basis of target lens shape data, so that the front shape of the lens LE is measured. Similar to this, when the rear shape of the lens LE (the position of the rear edge of the lens LE) is measured, the lens LE is moved toward the right side in FIG. 3, so that the measuring element 303 comes in contact with the rear surface of the lens LE. The measuring element 303 always comes in contact with the rear surface of the lens LE due to the spring of the detecting unit 320. In this state, while the lens LE is rotated, the carriage 110 is moved in the Y-direction on the basis of the target lens shape data, so that the rear shape of the lens LE is measured.

Figure 4:
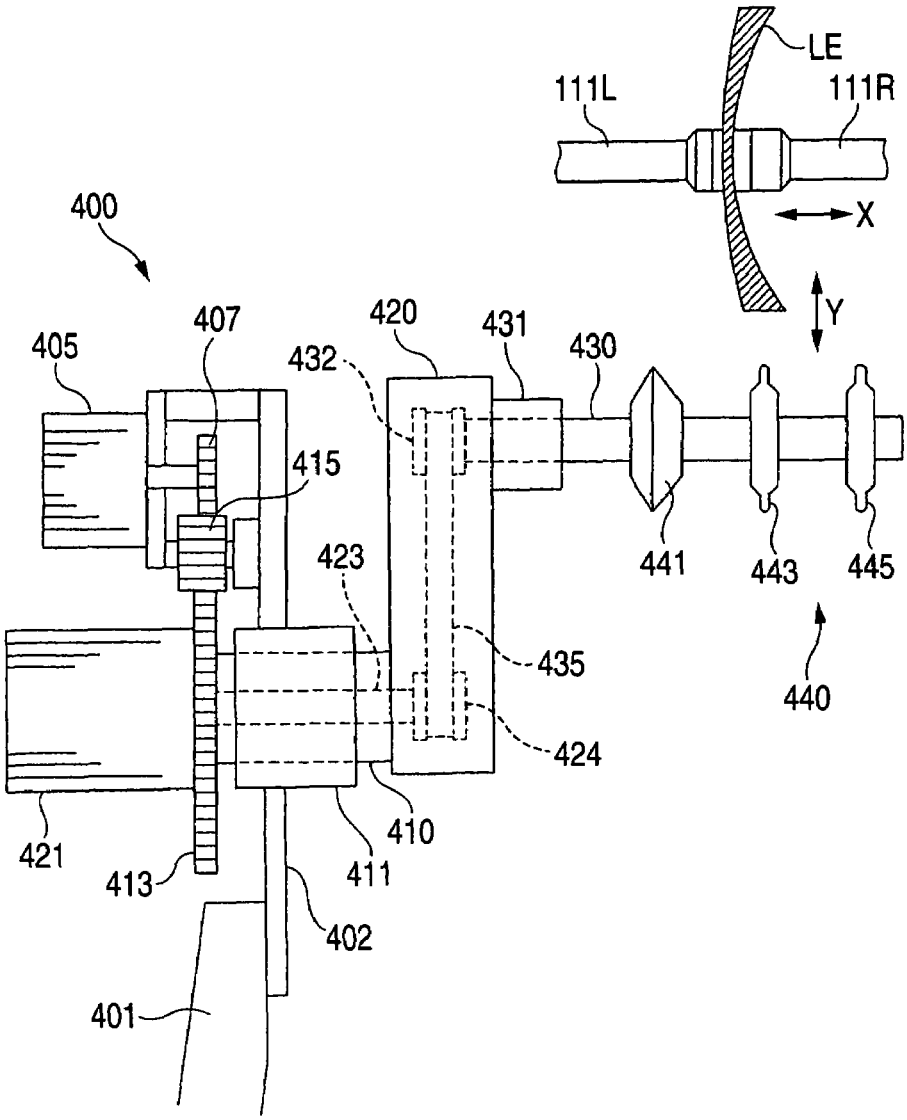
FIG. 4 is a view showing a schematic structure of a grooving and chamfering unit.

A grooving and chamfering unit 400 is disposed on the front side of the carriage 110 (refer to FIG. 2). FIG. 4 is a view showing the schematic structure of the grooving and chamfering unit 400. A fixing plate 402 is fixed to a block 401 (refer to FIG. 2) provided on a base 101. A grindstone moving motor 405 is fixed to the upper portion of the fixing plate 402. The motor 405 rotates an arm 420 so as to move a grinding (processing) unit 440 to a process position or a retraction position. A holding member 411 by which an arm rotating member 410 is rotatably held is fixed to the fixing plate 402, and a gear 413 is fixed to the arm rotating member 410 extending over the fixing plate 402. A gear 407 is fixed to a rotation shaft of the motor 405, and the torque of the gear 407 caused by the motor 405 is transmitted to the gear 413 via a gear 415, so that the arm 420 fixed to the arm rotating member 410 is rotated.

A grindstone rotating motor 421 is fixed to the gear 413, and a rotation shaft of the motor 421 is connected to a rotation shaft 423 that is rotatably held in the arm rotating member 410. A pulley 424 is fixed to the front end of the rotation shaft 423 extending to the arm 420. A holding member 431 by which a grindstone spindle 430 is rotatably held is fixed to the tip of the arm 420. A pulley 432 is fixed to the rear end of the grindstone spindle 430. The pulleys 432 and 424 are connected with each other via a belt 435, and the torque of the motor 421 is transmitted to the grindstone spindle 430, so that the grindstone spindle 430 is rotated. A chamfering grindstone 441, a regular-grooving grindstone 443 used as a regular-grooving tool, a fine-grooving grindstone (a mirror-grooving grindstone) 445 used as a fine-grooving tool are concentrically fixed to the grindstone spindle 430. It is preferable that the granularity of the regular-grooving grindstone 443 be in the range of #300 to #800, and it is preferable that the granularity of the fine-grooving grindstone 445 be in the range of #1000 to #3000.

Further, the chamfering grindstone 441 may be composed of a chamfering grindstone for chamfering the front surface of the lens and a chamfering grindstone for chamfering the rear surface of the lens, which are integrally formed. Alternatively, the chamfering grindstone 441 may be composed of a chamfering grindstone for chamfering the front surface of the lens and a chamfering grindstone for chamfering the rear surface of the lens, which are separately formed. Further, a grooving cutter may be used as the regular-grooving grindstone 443.

Figure 5A:
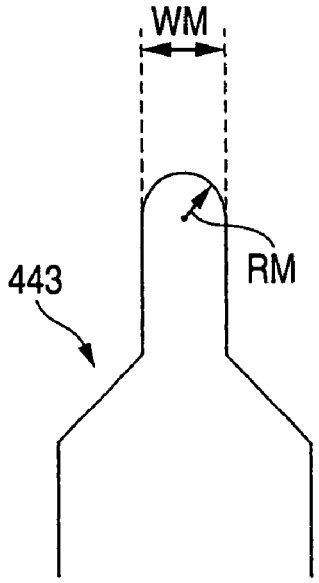
FIG. 5 is an enlarged view of a regular-grooving grindstone and a fine-grooving grindstone.
Figure 5B:
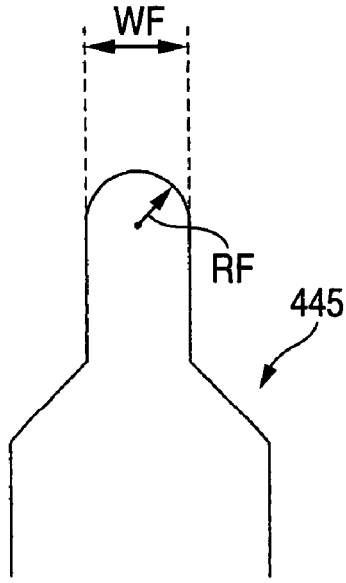

FIG. 5A is an enlarged view of the regular-grooving grindstone 443, and FIG. 5B is an enlarged view of the fine-grooving grindstone 445. The regular-grooving grindstone 443 has a processing width WM of 0.5 mm and is formed in a semicircular shape having a radius RM of 0.25 mm in a cross section thereof. Meanwhile, the fine-grooving grindstone 445 has a processing width WF of 0.6 mm and is formed in a semicircular shape having a radius RF of 0.3 mm in a cross section thereof. That is, a margin $\Delta d$ for the fine-grooving tolerance on one side surface of the groove to be formed is 0.05 mm, and the processing width WM of the regular-grooving grindstone 443 is smaller than the processing width WF of the fine-grooving grindstone 445 by 0.1 mm, which is the fine-grooving margin $2\Delta d$ on both (opposite) side surfaces of the groove to be formed. Further, each of the regular-grooving grindstone 443 and the fine-grooving grindstone 445 has an outer diameter of 30 mm.

The arm 420 is rotated by the motor 405 during the grooving and chamfering, so that the grindstone spindle 430 is moved from the retraction position to the process position. The process position of the grindstone spindle 430 is a position where a rotating axis of the grindstone spindle 430 becomes parallel to the rotating axes of the lens chucks 111L and 111R and the rotation axis of the grindstone spindle 150 on a plane defined by the both rotation axes between the lens chucks 111L and 111R and the grindstone spindle 150. In the same manner as the processing performed by the grindstone 151, the lens LE is moved in the X-direction by the motor 132, and the lens LE is moved in the Y-direction by the motor 141.

Further, a grooving tool, which is moved relative to a lens held by lens chucks, may be used as the grooving unit as disclosed in U.S. Pat. No. 6,942,542B (JP-A-2003-145400) which is hereby incorporated by reference. Further, a regular-grooving tool and a fine-grooving tool may be fixed to separate spindles.

Figure 6:
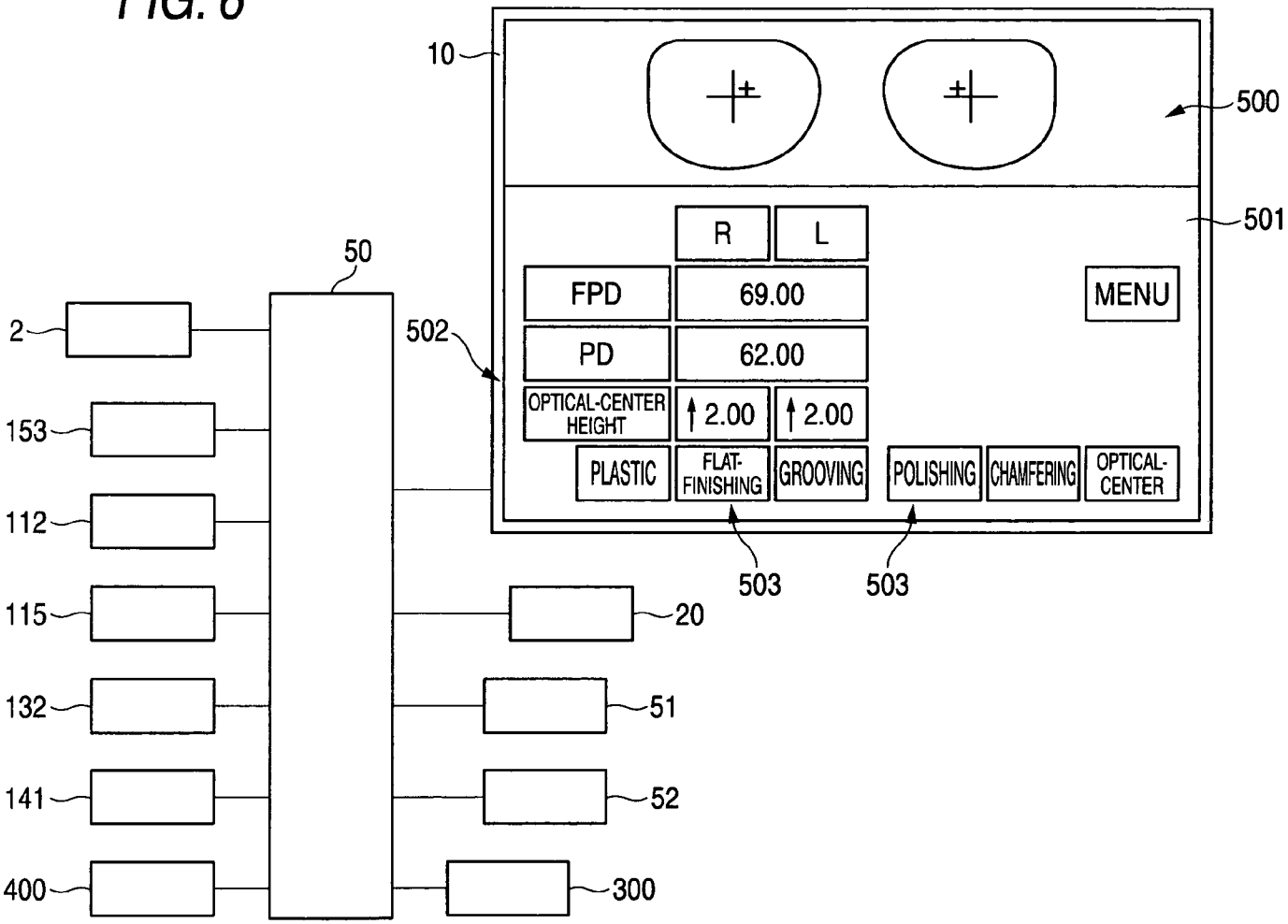
FIG. 6 is a schematic block diagram of a control system of the present apparatus.

Next, the operation of the present apparatus will be described with reference to a schematic block diagram of a control system of the present apparatus shown in FIG. 6. In this case, the case when the grooving is performed on the peripheral surface (the edge surface) of the lens LE will be mainly described. First, target lens shape data is input. Measurement is performed by the measuring device 2 for measuring an eyeglass frame, a template (a pattern), a demo lens (model lens), and the like, input is provided from the outside through communication devices, and information previously stored in a data memory 51 is read, so as to perform the input of the target lens shape data. When the target lens shape data is input, a target lens shape graphic based on the target lens shape data is displayed on the display 10, so that layout data and processing conditions can be input (refer to FIG. 6). The displaying on the display 10 is controlled by an operation control unit 50.

The layout data such as a pupillary distance PD of a user, a frame pupillary distance FPD, a height of an optical center o a lens with respect to a geometric center of the target lens shape, and the like is input by using buttons (keys) 502 displayed in an input field 501 on an input screen 500 of the display 10. Further, processing conditions, such as a material of a lens, a processing , mode (a bevel-finishing mode or a flat-finishing mode), whether the grooving is performed, whether the polishing is performed, and whether the chamfering is performed, are input by buttons (keys) switches 503 displayed in the input field 501.

When the data required for the processing is input, the lens LE is held (chucked) by the lens chucks 111L and 111R and the processing start switch of the switch panel 20 is operated to operate the apparatus. The operation control unit 50 operates the lens measuring unit 300 before the processing so as to measure the position of the edge of the front and rear surfaces of the lens LE on the basis of the target lens shape data and the layout data. When the flat-finishing mode is selected, the operation control unit 50 determines (calculates) flat-finishing data on the basis of the measured edge position data. A processing point when the lens LE is rotated is determined (calculated) on the basis of a radius of the grindstone 151, and a distance Li between a rotation center (a processing center) of the lens LE and a rotation center of the grindstone 151 (a distance between the rotation axis of the lens chucks 111L and 111R and the rotation axis of the grindstone spindle 150), which corresponds to each rotation angle of the lens LE, is determined (calculated), so that the flat-finishing data is obtained. Roughing data is obtained as data that is larger than the flat-finishing data by a margin for the flat-finishing.

Further, when the grooving is selected, the operation control unit 50 determines (calculates) path data of a groove to be formed on the peripheral surface of the lens LE on the basis of the measured edge position data. For example, the path of the groove is determined (calculated) in the path of the middle of the groove so that the groove middle path divides the measured edge thickness at a predetermined ratio (for example, 5:5).

Figure 7:
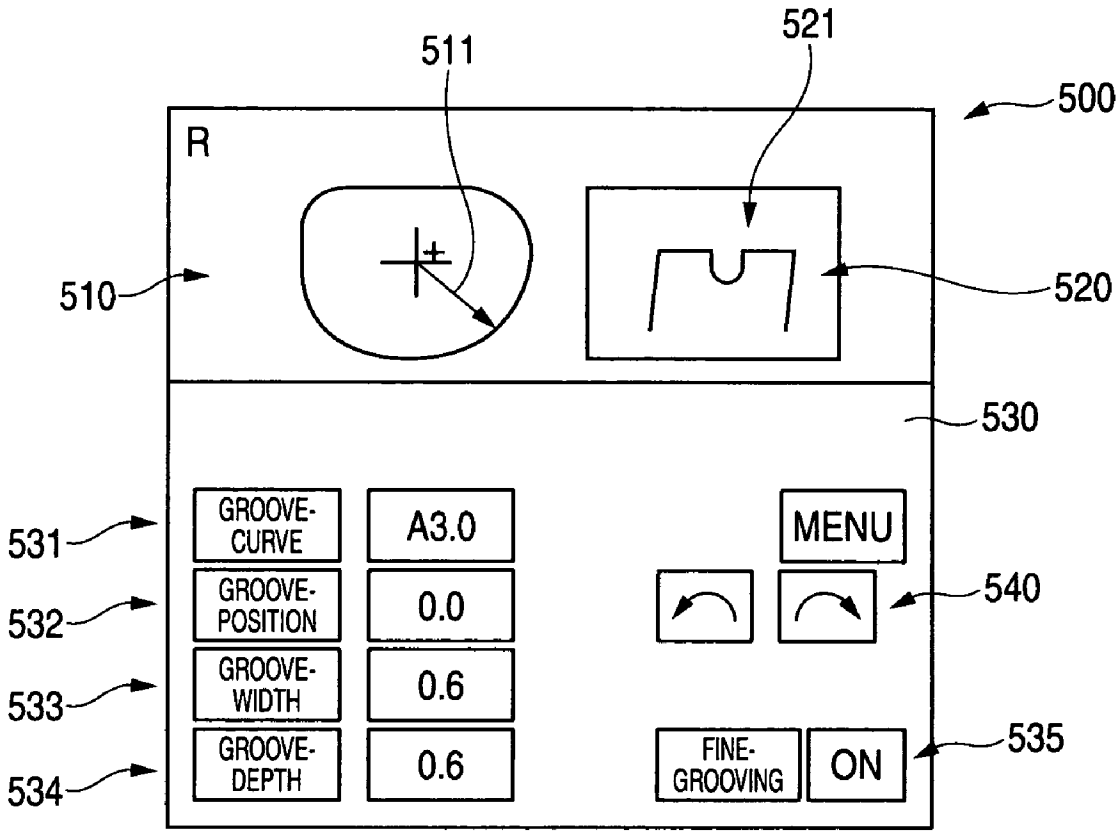
FIG. 7 is a view showing a simulation screen for inputting grooving data.

When the groove path data is obtained, the screen of the display 10 is changed into the simulation screen (refer to FIG. 7) used to input grooving data. A target lens shape graphic 510 of the lens LE held by the lens chucks 111L and 111R is displayed above the screen 500, and a cross-sectional graphic 520 of the groove is displayed at the right side on the screen. An input field 530 used to input the grooving data is displayed on the lower half of the screen. Further, a graphic corresponding to an edge position, which is designated by a line 511 displayed in the target lens shape graphic 510, is displayed as the cross-sectional graphic 520 of the groove. It is possible to change the positioned designated by the line 511 by using buttons (keys) 540 in the input field 530.

A button (key) 531 used to change curve values of the groove, and a button (key) 532 used to change the position of the groove corresponding to the front surface of the lens LE are provided in the input field 530. When the values are changed, a groove position 521 in the cross-sectional graphic 520 of the groove is also changed. Further, a groove width W can be input by using a button (key) 533, and a groove depth D can be input by using a button (key) 534. Numerals input by the buttons 531 to 534 can be input by numerical keys. Further, whether the fine-grooving is to be performed can be selected by a button (key) 535.

When the non-performance of the fine-grooving is selected (when only regular-grooving is selected), the minimum value of the groove width W allowed to be input by the button 533 is limited to the processing width WM of the regular-grooving grindstone 443. Meanwhile, when the performance of the fine-grooving is selected, the minimum value of the groove width W allowed to be input by the button 533 is limited to the sum of the processing width WM of the regular-grooving grindstone 443 and the fine-grooving margin Δd on each of the side surfaces of the groove (2Δd). Further, according to this embodiment, the processing width of the fine-grooving grindstone 445 is the sum of the processing width of the regular-grooving grindstone 443 and the fine-grooving margin Δd on each of the side surfaces of the groove (2Δd). For this reason, when the performance of the fine-grooving is selected, the minimum value of the groove width W allowed to be input by the button 533 is limited to the processing width WF of the fine-grooving grindstone 445.

The processing width WM of the regular-grooving grindstone 443, the processing width WF of the fine-grooving grindstone 445, and the fine-grooving margin Δd are stored in a memory 52 in advance. The operation control unit 50 can change the minimum value of the groove width N allowed to be input by the button 533, on the basis of the selection of the performance or non-performance of the fine-grooving.

Meanwhile, the maximum value of the groove width W allowed to be input by the button 533 is limited to the width smaller than the measured minimum edge thickness of the lens LE. If the groove width W that is smaller than the minimum value allowed to be input or larger than the maximum value allowed to be input is input, this is notified to an operator by warning messages, alarm, or the like.

Further, the grooving data such as the groove width W and the groove depth D, and the selection of the performance or non-performance of the fine-grooving may be input from the outside through communication devices.

When the grooving data is input and the processing start switch is again operated, first, the operation control unit 50 rotates the lens LE and moves the carriage 110 in the X-direction and Y-direction on the basis of the roughing data, so that the lens LE is processed by the roughing grindstone 151*a*. Next, the operation control unit 50 rotates the lens LE and moves the carriage 110 in the X-direction and Y-direction on the basis of the flat-finishing data, so that the lens LE is processed by the plane processing surface of the regular-finishing grindstone 151*b*. When the polishing is selected, the lens LE is further processed by the plane processing surface of the polishing grindstone 151*c*.

When the regular flat-finishing or the flat-polishing is completed, the grooving is performed. The operation control unit 50 moves the grindstone spindle 430 of the grooving and chamfering unit 400 to the process position, and then rotates the lens LE and moves the carriage 110 in the X-direction and Y-direction on the basis of the grooving data, so that the lens LE is processed by the regular-grooving grindstone 443. When the fine-grooving is selected, the lens LE is further processed by the fine-grooving grindstone 445.

The grooving data will be described below. The groove path data obtained on the basis of the edge position data is represented by referential symbols Rgn, θn, and Zn (n=1, 2, 3, . . . , N). Rgn indicates a radius formed by the center of the groove, and indicates a radius, which is obtained by subtracting the groove depth D from the radius of the target lens shape representing the shape of the flat-finished lens. θn indicates a radial angle. Zn indicates a position of the center of the groove in the X-direction (the central position of the groove width W). The grooving data in the depth direction of the groove (the Y-direction), which is based on the groove path data Rgn and θn is obtained as Lgi and θi (i=1, 2, 3, . . . , N) by determining a processing point every rotation angle θi of the lens LE on the basis of the radius of the regular-grooving grindstone 443 and/or fine-grooving grindstone 445 and determining a distance Lgi between the rotation axis of the lens chucks 111L, 111R and the rotation axis of the grindstone spindle 150 at every processing point. The grooving data in the width direction of the groove (the X-direction), which is based on the groove path data Zn and θn is obtained as Zi and θi(i=1, 2, 3, . . . , N) by determining a position Zi of the lens LE in the X-direction at every processing point based on the set groove.

In the case when the non-performance of the fine-grooving is selected (when only regular-grooving is selected), during one rotation of the lens LE, the operation control unit 50 moves the lens LE in the Y-direction with respect to the regular-grooving grindstone 443 on the basis of the grooving data Lgi and θi in the Y-direction, which is based on the set groove depth D. In this case, if the groove width W is set equal to the processing width WM of the regular-grooving grindstone 443, during one rotation of the lens LE, the operation control unit 50 moves the lens LE in the X-direction with respect to the regular-grooving grindstone 443 on the basis of the grooving data Zi and θi in the X-direction.

If the groove width W is larger than the processing width WM of the regular-grooving grindstone 443, the processing corresponding to the set grooving width W cannot be performed during one rotation of the lens LE. For this reason, the set groove width W is divided. For example, the lens LE is moved in the X-direction so that the grooving is performed on the front surface of the lens LE at the first rotation thereof, and the lens LE is moved in the X-direction so that the grooving is performed on the rear surface of the lens LE at the second rotation thereof. If the groove width W is set to 0.8 mm, the grooving is performed through the two rotations of the lens LE. For example, the lens LE is moved in the X-direction so that the grooving is performed on the front surface of the lens LE at the first rotation thereof, and the lens LE is moved in the X-direction so that the grooving is performed on the lens LE at the position to be shifted to the rear side of the lens LE by a predetermined width (for example, 0.1 mm). If the groove width W is set to 0.8 mm, the grooving is performed through the four rotations of the lens LE.

When the performance of the fine-grooving is selected, first, the lens LE is processed by the regular-grooving grindstone 443. The movement of the lens LE in the Y-direction with respect to the regular-grooving grindstone 443 is controlled on the basis of the grooving data Lgi and θi in the Y-direction so that the bottom of the groove has the fine-grooving margin Δd. Further, the movement of the lens LE in the X-direction with respect to the regular-grooving grindstone 443 is controlled on the basis of the grooving data Zi and θi in the X-direction so that each of the side surfaces of the groove has the fine-grooving margin Δd. After the regular-grooving, the lens LE is processed by the fine-grooving grindstone 445. The movement of the lens LE in the Y-direction with respect to the fine-grooving grindstone 445 is controlled so that the fine-grooving margin Δd is removed from the bottom of the groove. Further, the movement of the lens LE in the X-direction with respect to the fine-grooving grindstone 445 is controlled so that the fine-grooving margin Δd is removed from each of the side surfaces of the groove.

Figure 8B:
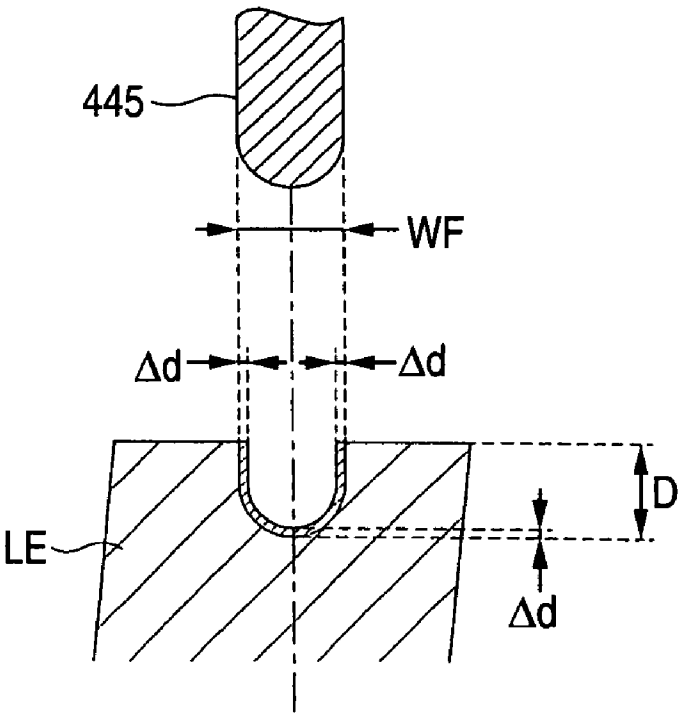
FIG. 8 is a view illustrating grooving when a width of a groove to be formed is set equal to a processing width of the fine-grooving grindstone.
Figure 8A:
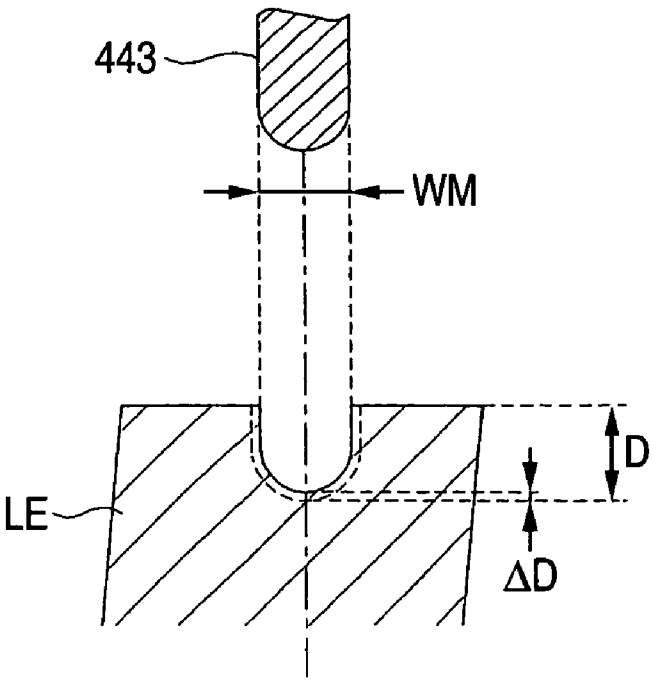

The case when the groove width W is set equal to the processing width WF of the fine-grooving grindstone 445 will be described. As shown in FIG. 8, the operation control unit 50 controls the movement of the lens LE in the Y-direction with respect to the regular-grooving grindstone 443 so that the bottom of the groove has the fine-grooving margin Δd. Further, the operation control unit 50 controls the movement of the lens LE in the X-direction with respect to the regular-grooving grindstone 443 so that each of the side surfaces of the groove have the fine-grooving margin Δd. As shown in FIG. 8B, after the regular-grooving, the control unit 50 controls the movement of the lens LE in the Y-direction with respect to the fine-grooving grindstone 445 so that the fine-grooving margin Δd is removed from the bottom of the groove. Further, the control unit 50 controls the movement of the lens LE in the X-direction with respect to the fine-grooving grindstone 445 so that the fine-grooving margin Δd is removed from each of the opposite side surfaces of the groove.

The case when the groove width W is set to be larger than the processing width WF of the fine-grooving grindstone 445 will be described. For example, the groove width W is set to 0.6 mm. As shown in FIG. 9, the control unit 50 controls the movement of the lens LE in the Y-direction with respect to the regular-grooving grindstone 443 so that the bottom of the groove has the fine-grooving margin Δd. Further, the operation control unit 50 controls the movement of the lens LE in the X-direction with respect to the regular-grooving grindstone 443 so that each of the side surfaces of the groove have the fine-grooving margin Δd. In this case, similar to the above-mentioned case when only regular-grooving is selected, a groove width W-Δd, which has -the fine-grooving margin Δd on each of the side surfaces of the groove, is divided. FIG. 9A shows an example in which the grooving is performed on the lens LE at the position to be shifted to the rear side of the lens LE from the front side thereof by a predetermined width.

Figure 9B:
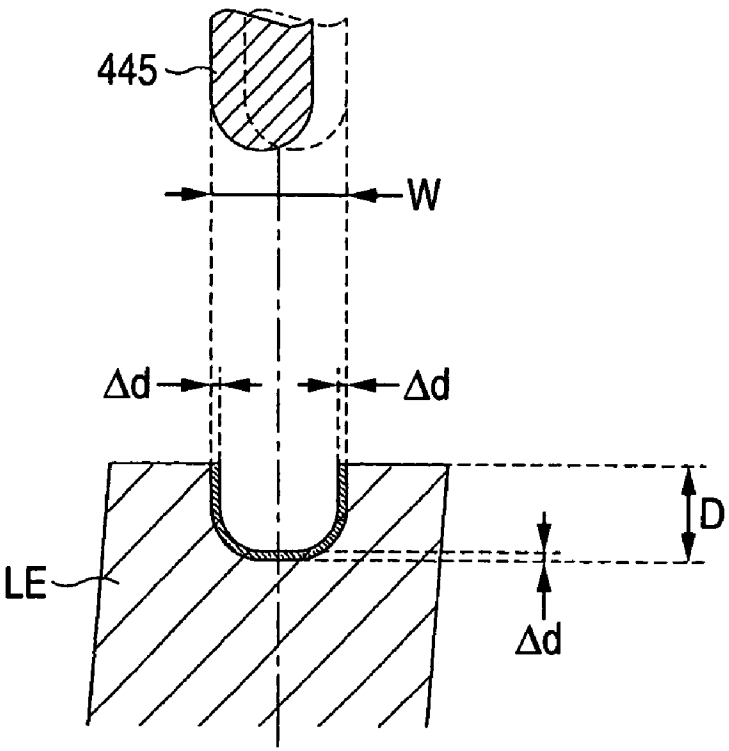
FIG. 9 is a view illustrating grooving when the width of the groove to be formed is set to be larger that the processing width of the fine-grooving grindstone.
Figure 9A:
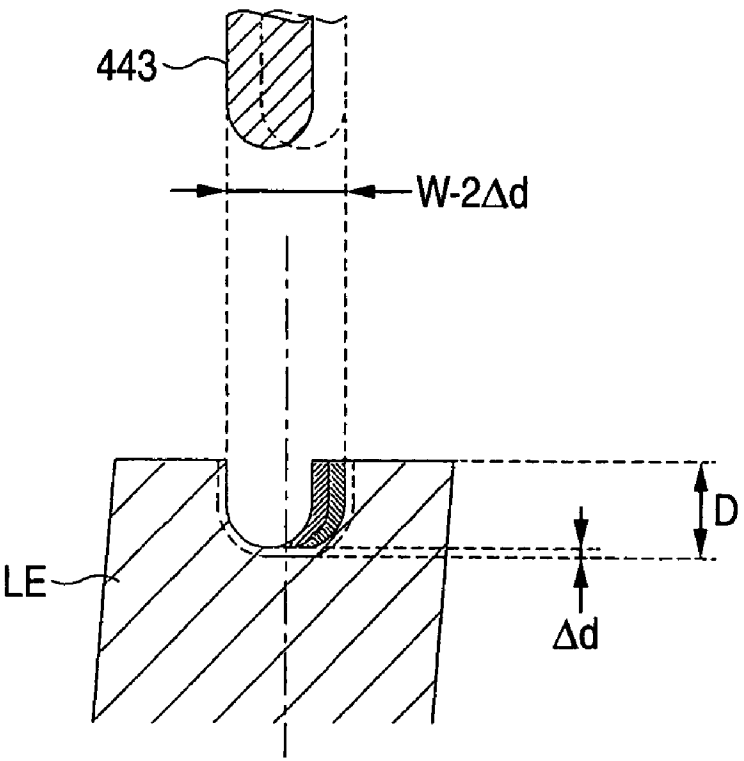

As shown in FIG. 9B, after the regular-grooving, the operation control unit 50 controls the movement of the lens LE in the Y-direction with respect to the fine-grooving grindstone 445 so that the fine-grooving margin Δd is removed from the bottom of the groove. Further, the control unit 50 controls the movement of the lens LE in the X-direction with respect to the fine-grooving grindstone 445 so that the fine-grooving margin Δd is removed from each of the side surfaces of the groove. Even in this case, similar to the above, the groove width W is divided. FIG. 9B shows an example in which the grooving is performed on the lens LE at the position to be shifted to the rear side of the lens LE from the front side thereof by a predetermined width.

What is claimed is:

1. An eyeglass lens processing apparatus for processing an eyeglass lens, the apparatus comprising:

a lens chuck that holds the lens;

a regular-grooving tool;

a first moving unit that relatively moves the lens held by the lens chuck with respect to the regular-grooving tool;

a grooving data input unit that inputs grooving data, the grooving data including a width and depth of the groove to be formed in the lens;

a controller that controls the first moving unit to perform regular-grooving on the lens on the basis of the input grooving data;

a fine-grooving tool;

a second moving unit that relatively moves the lens held by the lens chuck with respect to the fine-grooving tool; and a selector that selects whether or not fine-grooving is to be performed, wherein when performance of the fine-grooving is selected, the controller performs the regular-grooving on the lens so that a bottom and side surfaces of the groove have a margin for the fine-grooving, and controls the second moving unit to perform the fine-grooving on the lens on the basis of the input grooving data.

2. The eyeglass lens processing apparatus according to claim 1, wherein a processing width of the regular-grooving tool is smaller than a processing width of the fine-grooving tool by the fine-grooving margin on each of the side surfaces of the groove.

3. The eyeglass lens processing apparatus according to claim 2, wherein when non-performance of the fine-grooving is selected, a minimum value of the groove width allowed to be input is limited to the processing width of the regular-grooving tool, and when the performance of the fine-grooving is selected, the minimum value of the groove width allowed to be input is limited to the processing width of the fine-grooving tool.

4. The eyeglass lens processing apparatus according to claim 1, wherein a granularity of the regular-grooving tool is in a range of #300 to #800, and a granularity of the fine-grooving tool is in a range of #1000 to #3000.

5. The eyeglass lens processing apparatus according to claim 1, wherein the regular-grooving tool and the fine-grooving tool have a same outer diameter and are fixed to a same spindle.

6. The eyeglass lens processing apparatus according to claim 1, further comprising:

a roughing tool;

a third moving unit that relatively moves the lens held by the lens chuck with respect to the roughing tool;

a flat-finishing tool;

a fourth moving unit that relatively moves the lens held by the lens chucks with respect to the flat-finishing tool; and a target lens shape data input unit that inputs target lens shape data, wherein the control unit controls the third and fourth moving units to perform roughing and flat-finishing on the lens on the basis of the input target lens shape data.

7. The eyeglass lens processing apparatus according to claim 6 further comprising an operation unit that obtains the grooving data based on the input target lens shape data, wherein the grooving data input unit inputs the obtained grooving data.

* * * * *